US006536358B1

(12) United States Patent
Fears

(10) Patent No.: US 6,536,358 B1
(45) Date of Patent: Mar. 25, 2003

(54) FOLDABLE AND TRANSPORTABLE TABLE ASSEMBLY

(76) Inventor: Marva J. Fears, 1980 Delphine Dr., Decatur, GA (US) 30032

( * ) Notice: Subject to any disclaimer, the term of this patent is extended or adjusted under 35 U.S.C. 154(b) by 0 days.

(21) Appl. No.: 09/844,331

(22) Filed: Apr. 27, 2001

(51) Int. Cl.[7] ..... A47B 3/02
(52) U.S. Cl. ..... 108/116; 108/125
(58) Field of Search ..... 108/125, 116, 108/126, 129, 115, 33, 34, 35

(56) References Cited

U.S. PATENT DOCUMENTS

| | | | | |
|---|---|---|---|---|
| 1,891,734 | A | * | 12/1932 | Slee |
| D91,315 | S | | 1/1934 | Brown |
| 2,747,957 | A | | 5/1956 | Lencioni |
| 3,156,510 | A | * | 11/1964 | Hindin et al. |
| 3,334,930 | A | * | 8/1967 | Larson |
| 3,368,504 | A | | 2/1968 | Cohen |
| 4,156,449 | A | * | 5/1979 | Petersen |
| 4,938,153 | A | | 7/1990 | Maes |
| 5,357,872 | A | | 10/1994 | Wilmore |
| 5,421,273 | A | * | 6/1995 | Lin |
| 5,454,540 | A | * | 10/1995 | McPherson et al. |
| 5,562,052 | A | | 10/1996 | Glashouwer et al. |
| 5,628,439 | A | | 5/1997 | O'hara |
| 5,765,487 | A | * | 6/1998 | Neff |
| 5,873,312 | A | * | 2/1999 | Mauro-Vetter |
| 6,079,338 | A | * | 6/2000 | Yeh |

FOREIGN PATENT DOCUMENTS

| | | | |
|---|---|---|---|
| DE | 1239826 | * | 5/1967 |

* cited by examiner

*Primary Examiner*—Jose V. Chen

(57) ABSTRACT

A foldable and transportable table assembly for providing a portable desk that can be folded into a compact unit for storage and transport. The foldable and transportable table assembly includes a tabletop having a top wall and side walls depending from the top wall; and also includes a leg assembly being attached to the tabletop; and further includes a carrying case for carrying the tabletop and the leg assembly.

1 Claim, 3 Drawing Sheets

FOLDABLE AND TRANSPORTABLE TABLE ASSEMBLY

BACKGROUND OF THE INVENTION

1. Field of the Invention

The present invention relates to a portable and compact table and more particularly pertains to a new foldable and transportable table assembly for providing a portable desk that can be folded into a compact unit for storage and transport.

2. Description of the Prior Art

The use of a portable and compact table is known in the prior art. More specifically, a portable and compact table heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,357,872; 5,628,439; 5,562,052; 3,368,504; 2,747,957; and 4,938,153.

While these devices fulfill their respective, particular objectives and requirements, the aforementioned patents do not disclose a new foldable and transportable table assembly. The inventive device includes a tabletop having a top wall and side walls depending from the top wall; and also includes a leg assembly being attached to the tabletop; and further includes a carrying case for carrying the tabletop and the leg assembly.

In these respects, the foldable and transportable table assembly according to the present invention substantially departs from the conventional concepts and designs of the prior art, and in so doing provides an apparatus primarily developed for the purpose of providing a portable desk that can be folded into a compact unit for storage and transport.

SUMMARY OF THE INVENTION

In view of the foregoing disadvantages inherent in the known types of portable and compact table now present in the prior art, the present invention provides a new foldable and transportable table assembly construction wherein the same can be utilized for providing a portable desk that can be folded into a compact unit for storage and transport.

The general purpose of the present invention, which will be described subsequently in greater detail, is to provide a new foldable and transportable table assembly which has many of the advantages of the portable and compact table mentioned heretofore and many novel features that result in a new foldable and transportable table assembly which is not anticipated, rendered obvious, suggested, or even implied by any of the prior art portable and compact table, either alone or in any combination thereof.

To attain this, the present invention generally comprises a tabletop having a top wall and side walls depending from the top wall; and also includes a leg assembly being attached to the tabletop; and further includes a carrying case for carrying the tabletop and the leg assembly.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new foldable and transportable table assembly which has many of the advantages of the portable and compact table mentioned heretofore and many novel features that result in a new foldable and transportable table assembly which is not anticipated, rendered obvious, suggested, or even implied by any of the prior art portable and compact table, either alone or in any combination thereof.

It is another object of the present invention to provide a new foldable and transportable table assembly which may be easily and efficiently manufactured and marketed.

It is a further object of the present invention to provide a new foldable and transportable table assembly which is of a durable and reliable construction.

An even further object of the present invention is to provide a new foldable and transportable table assembly which is susceptible of a low cost of manufacture with regard to both materials and labor, and which accordingly is then susceptible of low prices of sale to the consuming public, thereby making such foldable and transportable table assembly economically available to the buying public.

Still yet another object of the present invention is to provide a new foldable and transportable table assembly which provides in the apparatuses and methods of the prior art some of the advantages thereof, while simultaneously overcoming some of the disadvantages normally associated therewith.

Still another object of the present invention is to provide a new foldable and transportable table assembly for providing a portable desk that can be folded into a compact unit for storage and transport.

Yet another object of the present invention is to provide a new foldable and transportable table assembly which includes a tabletop having a top wall and side walls depending from the top wall; and also includes a leg assembly being attached to the tabletop; and further includes a carrying case for carrying the tabletop and the leg assembly.

Still yet another object of the present invention is to provide a new foldable and transportable table assembly that is easy and convenient to set up and use.

Even still another object of the present invention is to provide a new foldable and transportable table assembly that can be taken and used anywhere.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
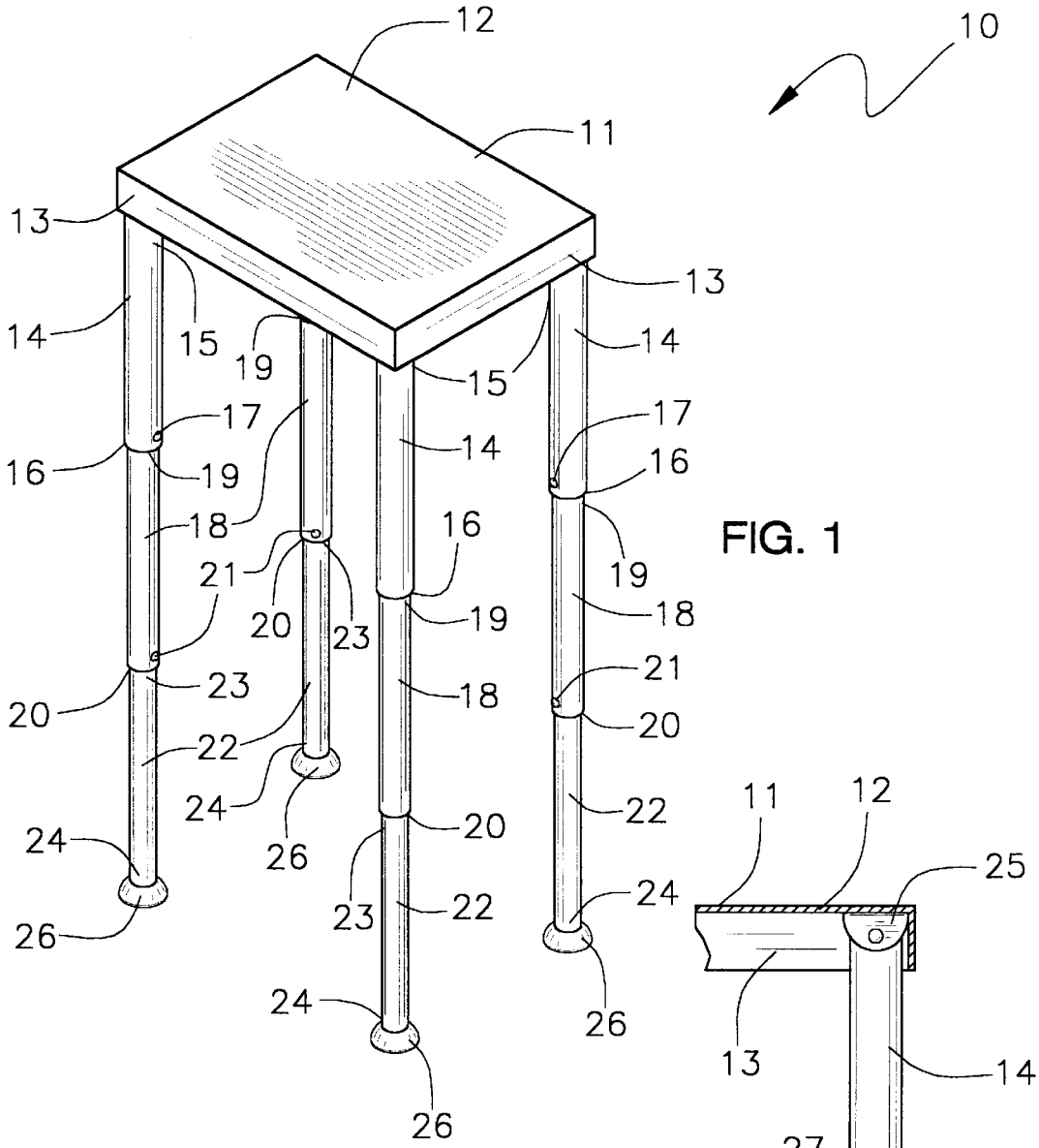
FIG. 1 is a perspective view of a new foldable and transportable table assembly according to the present invention.
Figure 2:
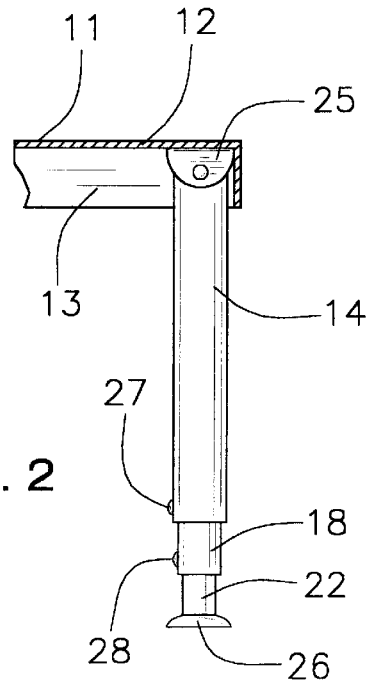
FIG. 2 is a detailed side elevational view of one of the leg members of the present invention.
Figure 3:
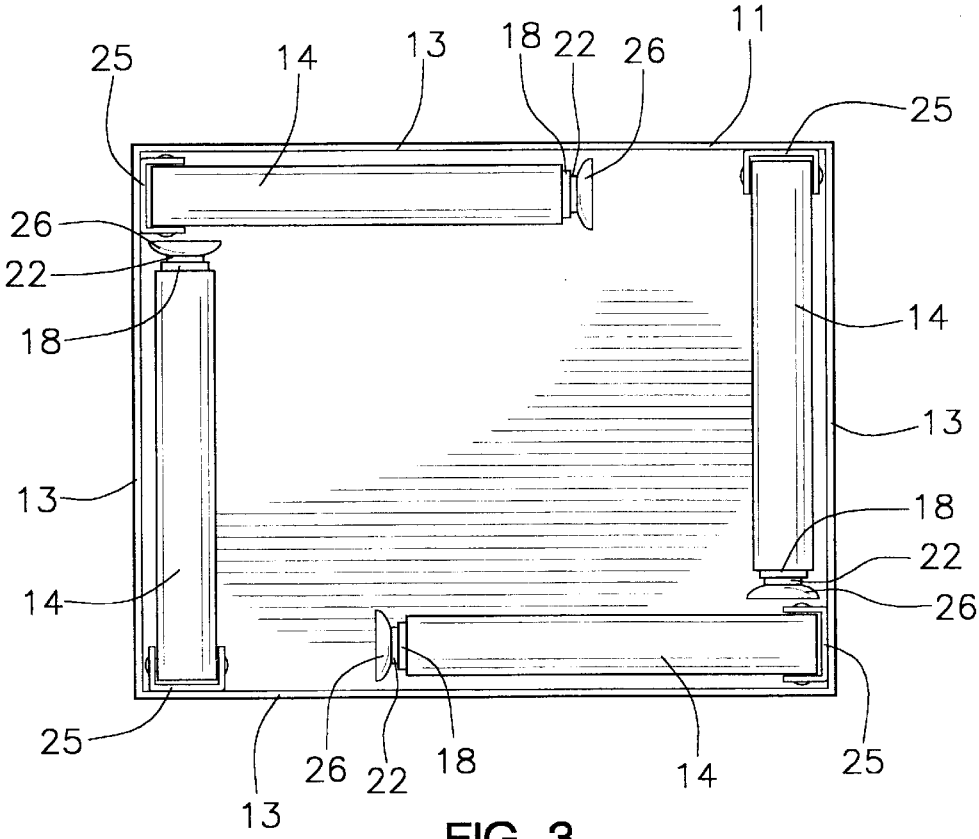
FIG. 3 is a bottom plan view of the present invention in a folded position.
Figure 4:
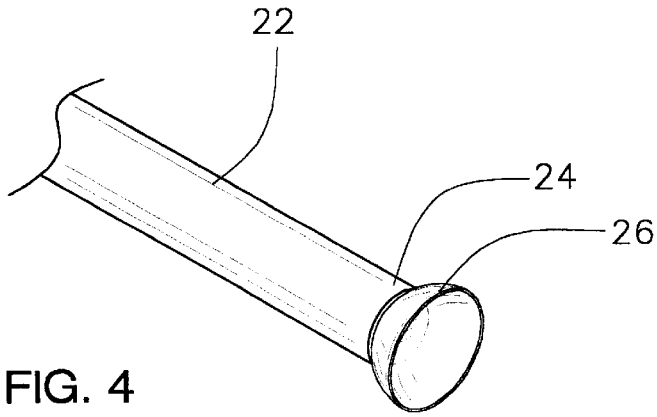
FIG. 4 is a partial perspective view of one of the leg members of the present invention.
Figure 5:
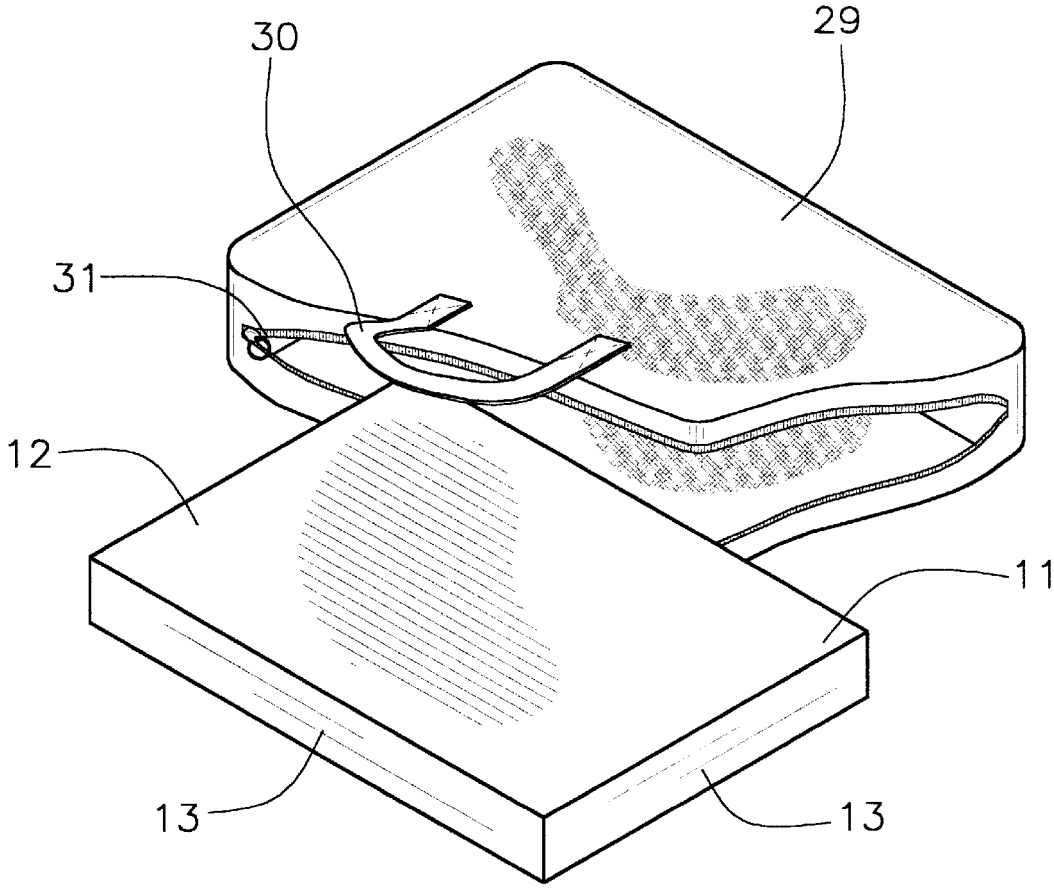
FIG. 5 is a perspective view of the present invention being stored.

With reference now to the drawings, and in particular to FIGS. 1 through 5 thereof, a new foldable and transportable table assembly embodying the principles and concepts of the present invention and generally designated by the reference numeral 10 will be described.

As best illustrated in FIGS. 1 through 5, the foldable and transportable table assembly 10 generally comprises a tabletop 11 having a top wall 12 and side walls 13 depending from the top wall 12 with the top wall 12 being approximately 14 inches long and 10 inches wide and with the side walls 13 being approximately 1¾ to 2 inches long. A leg assembly is conventionally attached to the tabletop 11. The leg assembly includes a plurality of bracket members 25 being securely and conventionally attached to an underside of the top wall 12 of the tabletop 11, and also includes a plurality of leg members 14,18,22 being hingedly attached to the bracket members 25, and further includes a plurality of fastening members 26 being securely and conventionally attached to the leg members 14,18,22 for attaching to a surface. Each of the bracket members 25 is generally U-shaped. Each of the leg members 14,18,22 includes a first tubular member 14 having a first end 15 which is hingedly attached to a respective bracket member 25 and also having an open second end 16 and further having a hole 17 being disposed through a wall thereof near the open second end 16, and also includes a second tubular member 18 having a first end 19, an open second end 20 and a hole 21 being disposed through a wall thereof near the open second end 20 thereof and being telescopingly and fastenably received in the first tubular member 14 through the open second end 16 of the first tubular member 14, and further includes a third tubular member 22 having first and second ends 23,24 and being telescopingly and fastenably received in the second tubular member 18 through the open second end 20 of the second tubular member 18. Each of the fastening members 25 is a suction cup which is securely and conventionally attached to the second end 24 of a respective the third tubular member 22 with the leg members 14,18,22 being foldable upon the underside of the tabletop 11. The leg assembly also includes first and second fasteners 27,28 being depressibly disposed through the holes 17,21 of the first and second tubular members 14,18. A carrying case 29 for carrying the tabletop 11 and the leg assembly includes at least one handle member 30 being securely and conventionally attached to a side wall thereof, and also includes a closure member 31 such as a zipper being securely and conventionally attached along edges of an opening into the carrying case 29.

In use, the user can remove the tabletop 11 and the leg assembly from the carrying case 29, and can unfold and extend the leg members 14,18,22 from the tabletop 11. To keep the tabletop from toppling over, the user can secure the leg members 14,18,22 to a surface using the suction cup members 25.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A foldable and transportable table assembly comprising:

a tabletop having a top wall and side walls depending from said top wall;

a leg assembly being attached to said tabletop, said leg assembly including a plurality of bracket members being securely attached to an underside of said top wall of said tabletop, and also including a plurality of leg members being hingedly attached to said bracket members, and further including a plurality of fastening members being securely attached to said leg members for attaching to a surface, each of said bracket members being generally U-shaped, each of said leg members including a first tubular member having a first end which is hingedly attached to a respective said bracket member and also having an open second end and further having a hole being disposed through a wall thereof near said open second end, and also including a second tubular member having a first end, an open second end and a hole being disposed through a wall thereof near said second end thereof and being telescopingly and fastenably received in said first tubular member through said open second end of said first tubular member, and further including a third tubular member having first and second ends and being telescopingly and fastenably received in said second tubular member through said open second end of said second tubular member, each of said fastening members being a suction cup which is securely attached to said second end of a respective said third tubular member, said leg members being foldable upon said underside of said tabletop, said leg assembly also including first and second fasteners being depressibly disposed through said holes of said first and second tubular members;

a carrying case for carrying said tabletop and said leg assembly, said carrying case including at least one handle member being securely attached to a side wall thereof, and also including a closure member such as a zipper being securely attached along edges of an opening into said carrying case; and wherein said carrying case is generally dimensionally equivalent to said tabletop to facilitate storing said tabletop without altering a shape or size of said tabletop.

* * * * *